US010757777B1

(12) United States Patent
Wang

(10) Patent No.: US 10,757,777 B1
(45) **Date of Patent: *Aug. 25, 2020**

(54) BRIGHTNESS ADJUSTMENT FOR A WHITE-LIGHT LAMP

(71) Applicant: Tiejun Wang, Lin'an (CN)

(72) Inventor: Tiejun Wang, Lin'an (CN)

( * ) Notice: Subject to any disclaimer, the term of this patent is extended or adjusted under 35 U.S.C. 154(b) by 0 days.

This patent is subject to a terminal disclaimer.

(21) Appl. No.: 16/687,869

(22) Filed: Nov. 19, 2019

Related U.S. Application Data

(63) Continuation-in-part of application No. 16/504,490, filed on Jul. 8, 2019, now Pat. No. 10,624,189.

(51) Int. Cl.

| | |
|---|---|
| ***H05B 37/02*** | (2006.01) |
| ***H05B 33/08*** | (2020.01) |
| ***F21V 23/00*** | (2015.01) |
| ***H05B 45/20*** | (2020.01) |
| ***H05B 45/46*** | (2020.01) |
| ***H05B 45/48*** | (2020.01) |
| ***H05B 47/19*** | (2020.01) |
| ***H05B 47/10*** | (2020.01) |
| ***H05B 45/10*** | (2020.01) |
| ***H05B 47/105*** | (2020.01) |
| ***H05B 45/00*** | (2020.01) |

(52) U.S. Cl.
CPC ..... *H05B 45/20* (2020.01); *F21V 23/001* (2013.01); *F21V 23/003* (2013.01); *H05B 45/00* (2020.01); *H05B 45/10* (2020.01); *H05B 45/46* (2020.01); *H05B 45/48* (2020.01); *H05B 47/10* (2020.01); *H05B 47/105* (2020.01); *H05B 47/19* (2020.01)

(58) Field of Classification Search
None
See application file for complete search history.

(56) References Cited

U.S. PATENT DOCUMENTS

| | | | | |
|---|---|---|---|---|
| 7,893,631 | B2 * | 2/2011 | Speier | H05B 45/22 315/308 |
| 8,159,125 | B2 * | 4/2012 | Miao | H05B 45/20 313/498 |
| 8,508,141 | B2 * | 8/2013 | Takeda | H05B 45/20 315/192 |
| 9,730,291 | B1 * | 8/2017 | Janik | H05B 45/20 |
| 9,839,083 | B2 * | 12/2017 | van de Ven | H05B 45/20 |
| 10,034,345 | B1 * | 7/2018 | Matsubayashi | F21V 3/0625 |
| 10,299,321 | B1 * | 5/2019 | Trask | H05B 45/20 |

(Continued)

*Primary Examiner* — Vibol Tan
(74) *Attorney, Agent, or Firm* — Daniel M. Cohn; Howard M. Cohn

(57) ABSTRACT

A controller provides power to (i) a first light-emitting device that emits a first white light of a first correlated color temperature (CCT) and (ii) a second light-emitting device that emits a second white light of a second CCT. The second CCT is lower than the first CCT. The first and second white lights mix to yield a combined white light having a combined CCT with a combined brightness. The controller receives a user-adjustable DC input voltage Vin. The controller distributes supply power to the first and second light-emitting devices according to a power-distribution scheme that differentiates between whether Vin is in an upper range or a lower range, as follows: (i) In the upper range: as Vin decreases, combined-light CCT decreases and combined-light brightness remains constant. (ii) In the lower range: as the Vin decreases, combined-light brightness decreases.

20 Claims, 6 Drawing Sheets

(56) References Cited

U.S. PATENT DOCUMENTS

| | | | | |
|---|---|---|---|---|
| 10,420,183 | B2 * | 9/2019 | Yamakawa | H01L 33/504 |
| 10,470,262 | B2 * | 11/2019 | Li | H05B 45/10 |
| 2012/0099303 | A1 * | 4/2012 | Li | H01L 25/0753 362/231 |
| 2016/0276549 | A1 * | 9/2016 | Yamashita | H01L 33/504 |
| 2018/0376555 | A1 * | 12/2018 | Wang | H05B 45/37 |
| 2019/0371768 | A1 * | 12/2019 | You | F21V 23/003 |

* cited by examiner

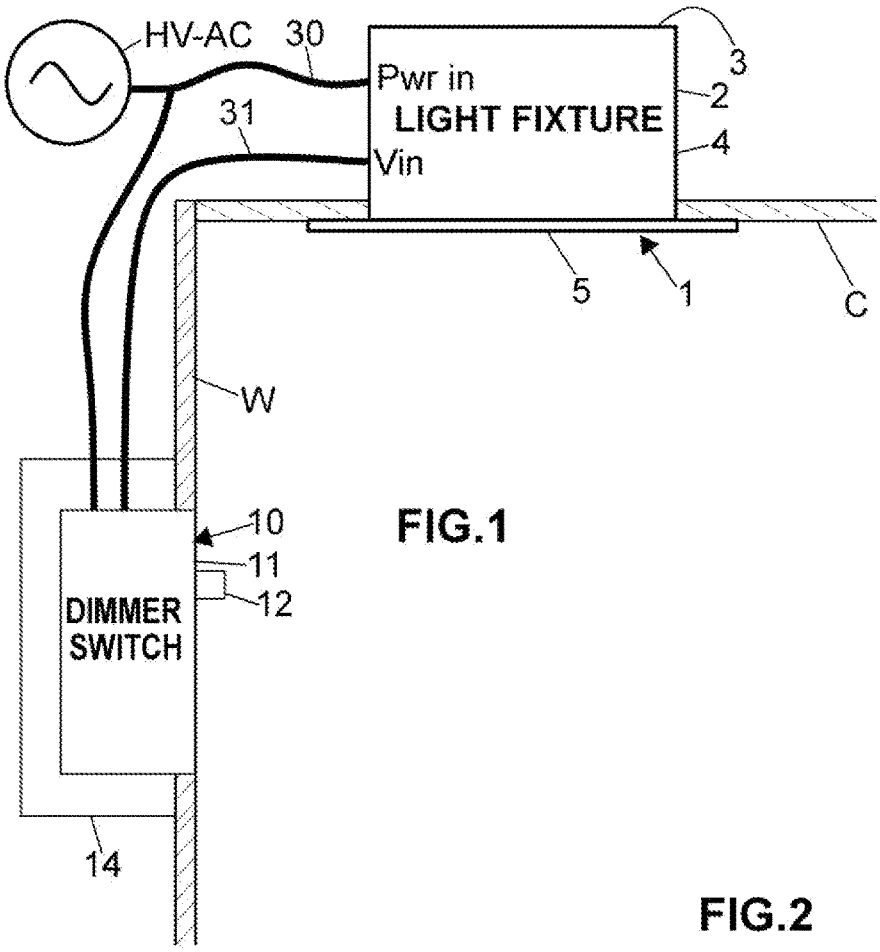
FIG.1
FIG.2
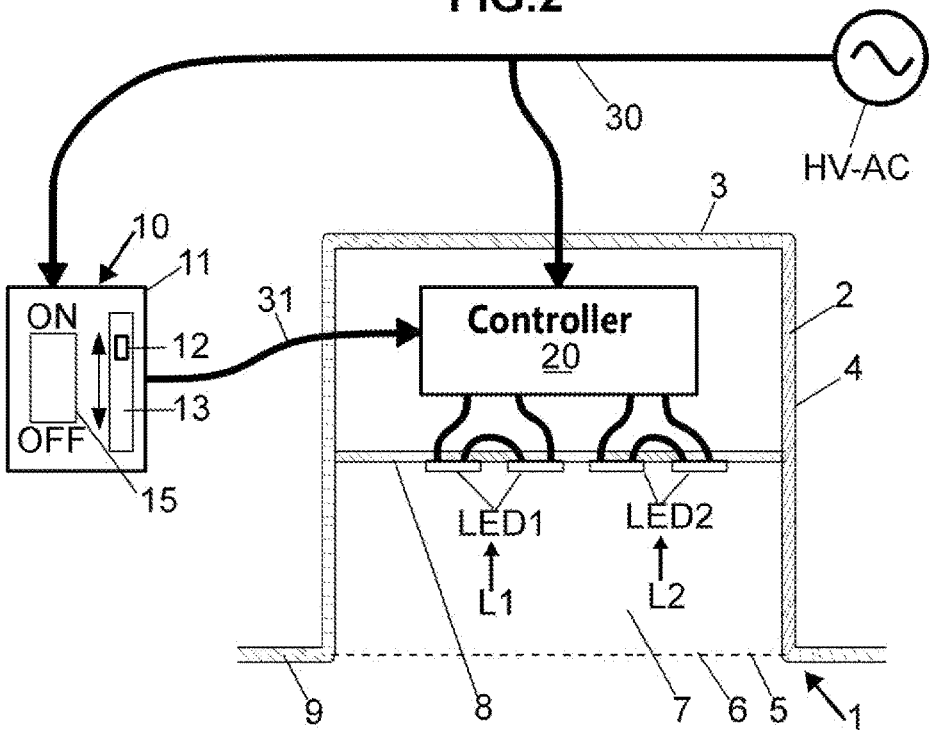

BRIGHTNESS ADJUSTMENT FOR A WHITE-LIGHT LAMP

CROSS REFERENCE TO RELATED APPLICATION

This is a continuation-in-part of U.S. application Ser. No. 16/504,490, filed Jul. 8, 2019, hereby incorporated in its entirety by reference.

FIELD OF THE INVENTION

This relates to an apparatus and method of varying the brightness and correlated color temperature (CCT) of a white light lamp.

BACKGROUND

A light dimmer is used to adjust power that is supplied to a lamp in order to adjust the brightness (amount of light) emitted by the lamp. An incandescent lamp's illumination is based on thermal radiation. Therefore, both output brightness and correlated color temperature (CCT) of an incandescent lamp's emitted light is a positive function of the lamp's input power, in that both brightness and CCT increase with increasing input power and decrease with decreasing power.

SUMMARY

A controller provides power to (i) a first light-emitting device that emits a first white light of a first correlated color temperature (CCT) and (ii) a second light-emitting device that emits a second white light of a second CCT. The second CCT is lower than the first CCT. The first and second white lights mix to yield a combined white light having a combined CCT with a combined brightness. The controller receives a user-adjustable DC input voltage Vin. The controller distributes supply power to the first and second light-emitting devices according to a power-distribution scheme that differentiates between whether Vin is in an upper range or a lower range, as follows: (i) In the upper range: as Vin decreases, combined-light CCT decreases and combined-light brightness remains constant. (ii) In the lower range: as the Vin decreases, combined-light brightness decreases.

The power-distribution scheme might further differentiate between whether Vin is in an upper portion of the lower range or a lower portion of the lower range, as follows: (i) In the upper portion of the lower range: as Vin decreases, the first brightness decreases, the second brightness remains constant, and the combined-light CCT decreases. (ii) In the lower portion of the lower range: as Vin decreases, the first brightness remains constant, and the second brightness decreases, and the combined-light CCT remains constant.

Electrical currents applied by the controller to the first and second light-emitting devices are respectively first current and second current. The sum of the first and second currents is combined current. The power-distribution scheme might further include the following: (i) In the upper range: as Vin decreases, the first current decreases, the second current increases, and the combined current remains constant. (ii) In the lower range: as Vin decreases, the combined current decreases.

The power-distribution scheme might further include the following: In the upper portion of the lower range: (i) As Vin decreases, the first current decreases, and the second current remains constant. (ii) In the lower portion of the lower range: as Vin decreases, the first current remains constant, and the second current decreases.

Electrical powers applied by the controller to the first and second light-emitting devices are respectively first power and second power. The sum of the first and second powers is combined power. The power-distribution scheme might further include the following: (i) In the upper range: as Vin decreases, the first power decreases, the second power increases, and the combined power remains constant. (ii) In the lower range: as Vin decreases, the combined power decreases.

The power-distribution scheme might further include the following: (i) In the upper portion of the lower range: as Vin decreases, the first power decreases, and the second power remains constant. (ii) In the lower portion of the lower range: as Vin decreases, the first power remains constant, and the second power decreases.

The lower range might be contiguous with the upper range.

The supply power might be obtained from a power source other than the user-adjustable DC input voltage Vin.

A lamp housing might support the first and second light-emitting devices in positions relative to each other such that the first white light will mix with the second white light to yield the combined white light. The first light-emitting device might comprise one or more LEDs, and the second light-emitting device might comprise one or more LEDs.

The first CCT might be in the range 4000K to 7000K. The second CCT might be in the range 1500K to 3000K. The combined-light CCT might be: in the range 4500K to 6500K when Vin is at a top of the upper range, in the range 2500K to 3500K when Vin is at a bottom of the upper range and a top of the lower range, and in the range 1500K to 2500K when Vin is at a bottom of the lower range.

A dimmer might provide the input supply power to the controller. The dimmer might include a user-interface component through which a user can adjust Vin. The user-interface component might be a physical component that is configured to be manually moved by a user to adjust Vin. The lamp housing might be configured to be mounted in a ceiling for recessed lighting.

BRIEF DESCRIPTION OF THE DRAWINGS

The structure, operation, and advantages of the present invention will become further apparent upon consideration of the following description taken in conjunction with the accompanying figures (FIGs.). The figures are intended to be illustrative, not limiting.

Certain elements in some of the figures may be omitted, or illustrated not-to-scale, for illustrative clarity. The cross-sectional views may be in the form of "slices", or "near-sighted" cross-sectional views, omitting certain background lines which would otherwise be visible in a "true" cross-sectional view, for illustrative clarity.

Figure 3:
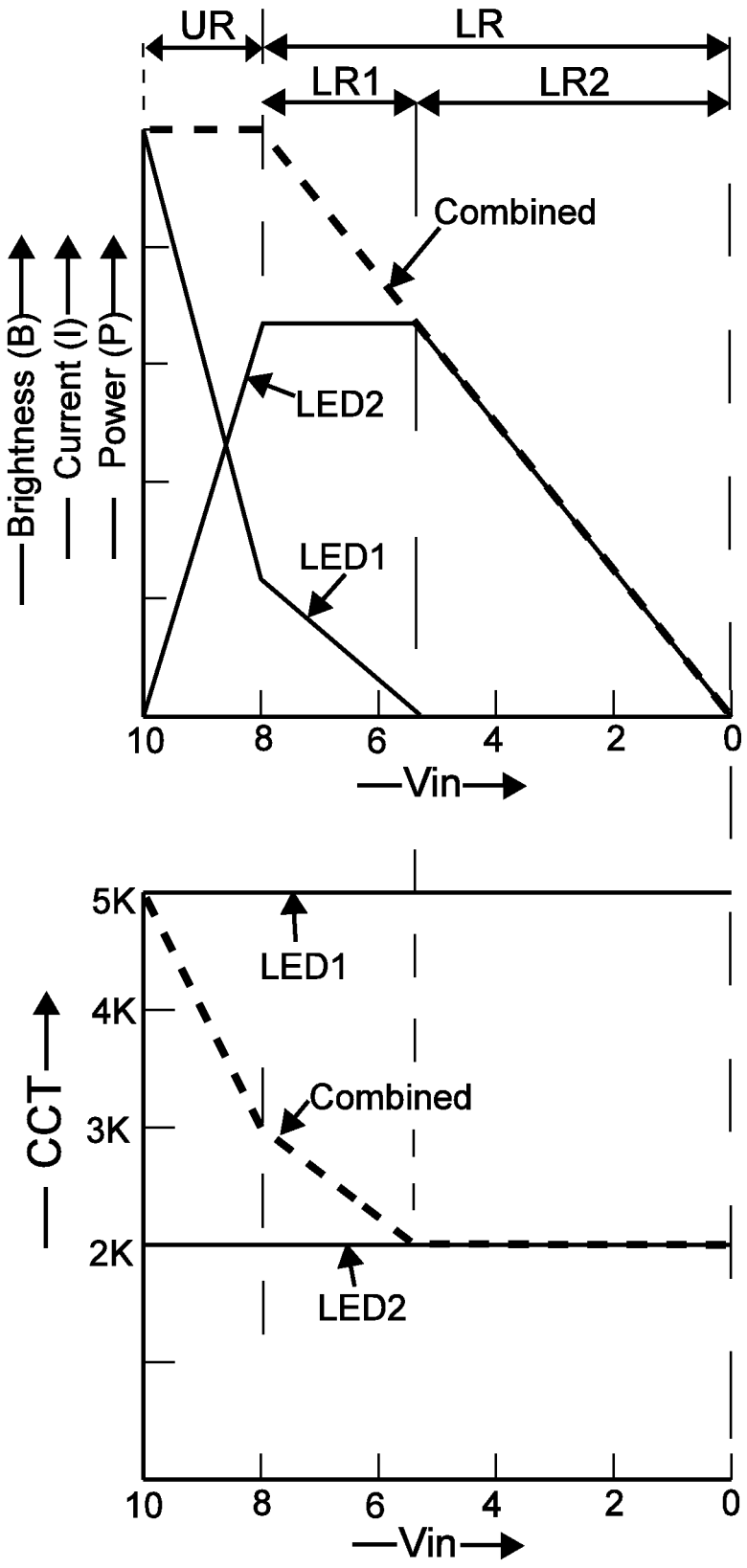

Often, similar elements may be referred to by similar numbers in various figures (FIGs) of the drawing, in which case typically the last two significant digits may be the same, the most significant digit being the number of the drawing figure (FIG). Furthermore, for clarity, some reference numbers may be omitted in certain drawings.

FIG. 1 is a diagram showing an example lighting apparatus that includes a dimmer switch mounted in a wall and a light fixture mounted in a ceiling, in which both the dimmer switch and the light fixture are shown in side view.

FIG. 2 is another diagram of the example lighting apparatus, in which the dimmer switch is shown in front view, and the light fixture is shown in sectional view that diagrammatically exposes components of the light fixture.

FIG. 3 shows graphs illustrating an example power-distribution scheme for apportioning power to different light-emitting devices of the lamp as a function of a characteristic of the input supply power.

Figure 4:
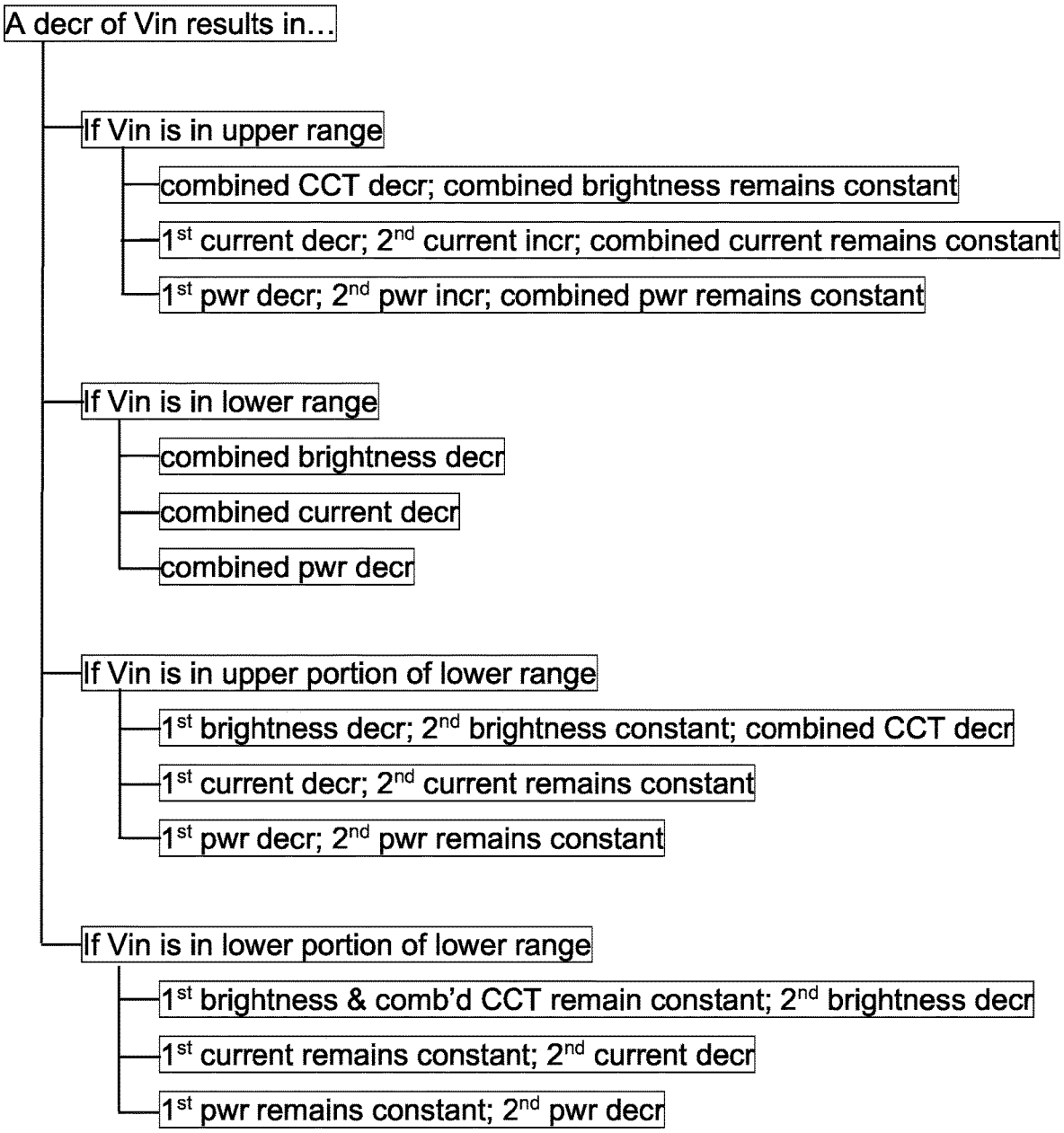

FIG. 4 is a flowchart of a method for implementing the power-distribution scheme.

Figure 5:
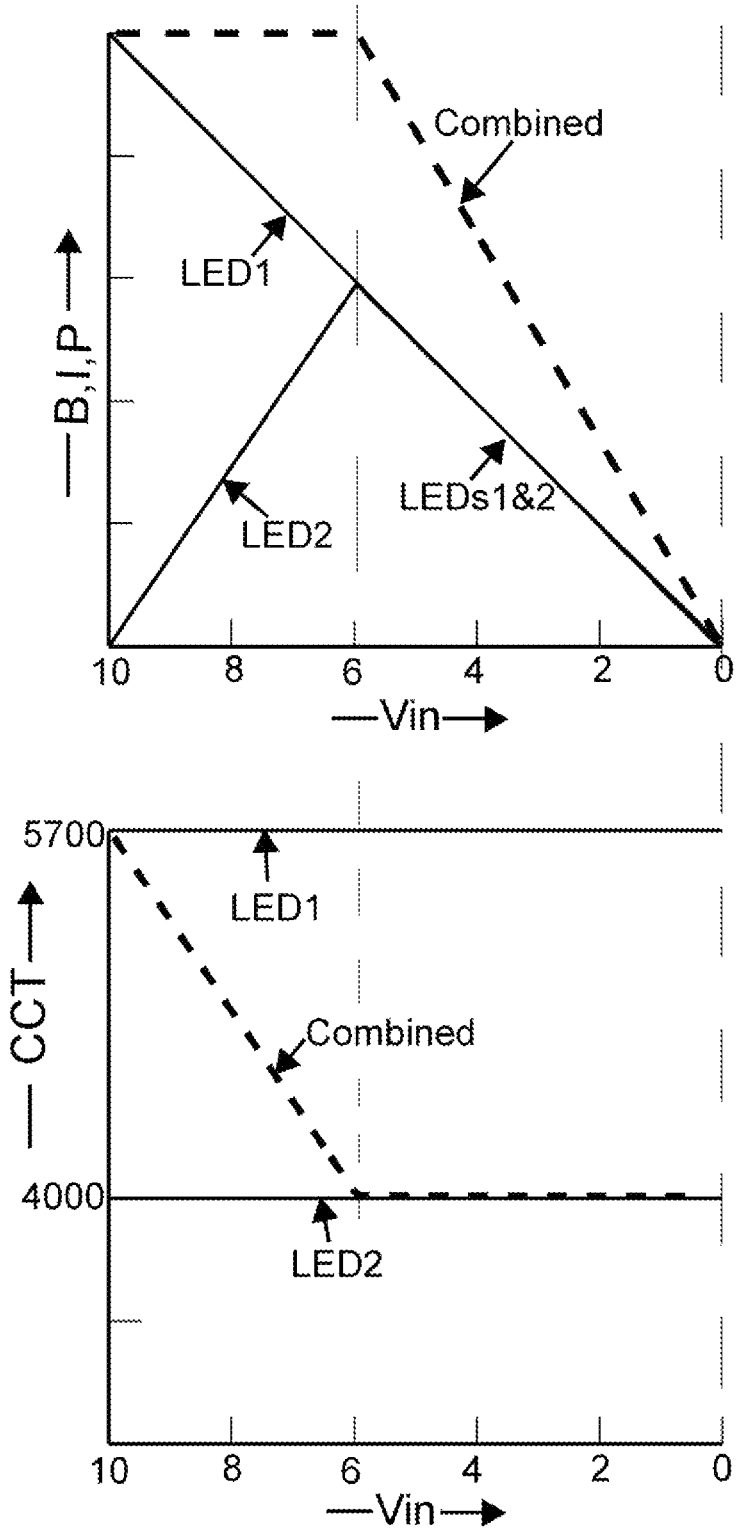
Figure 6:
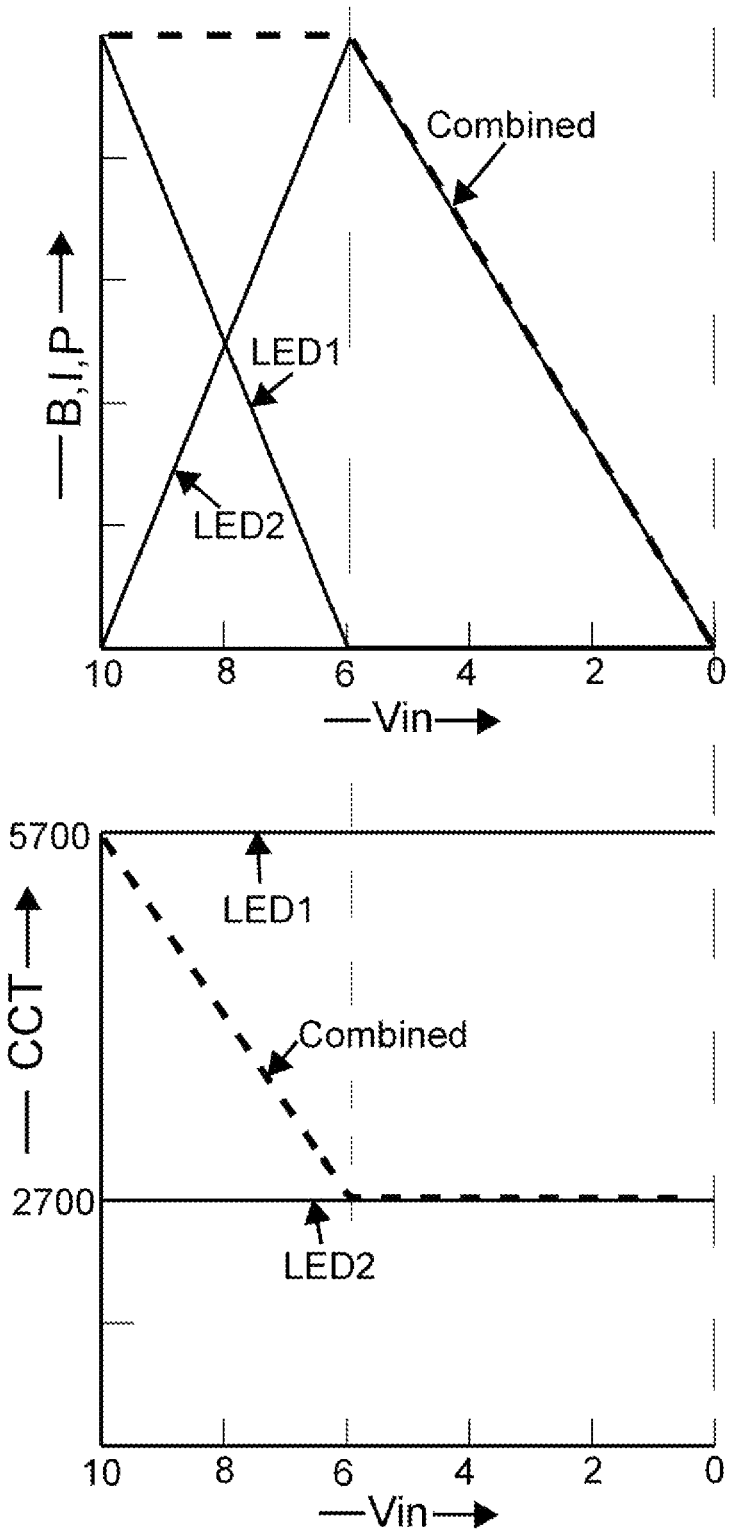
Figure 7:
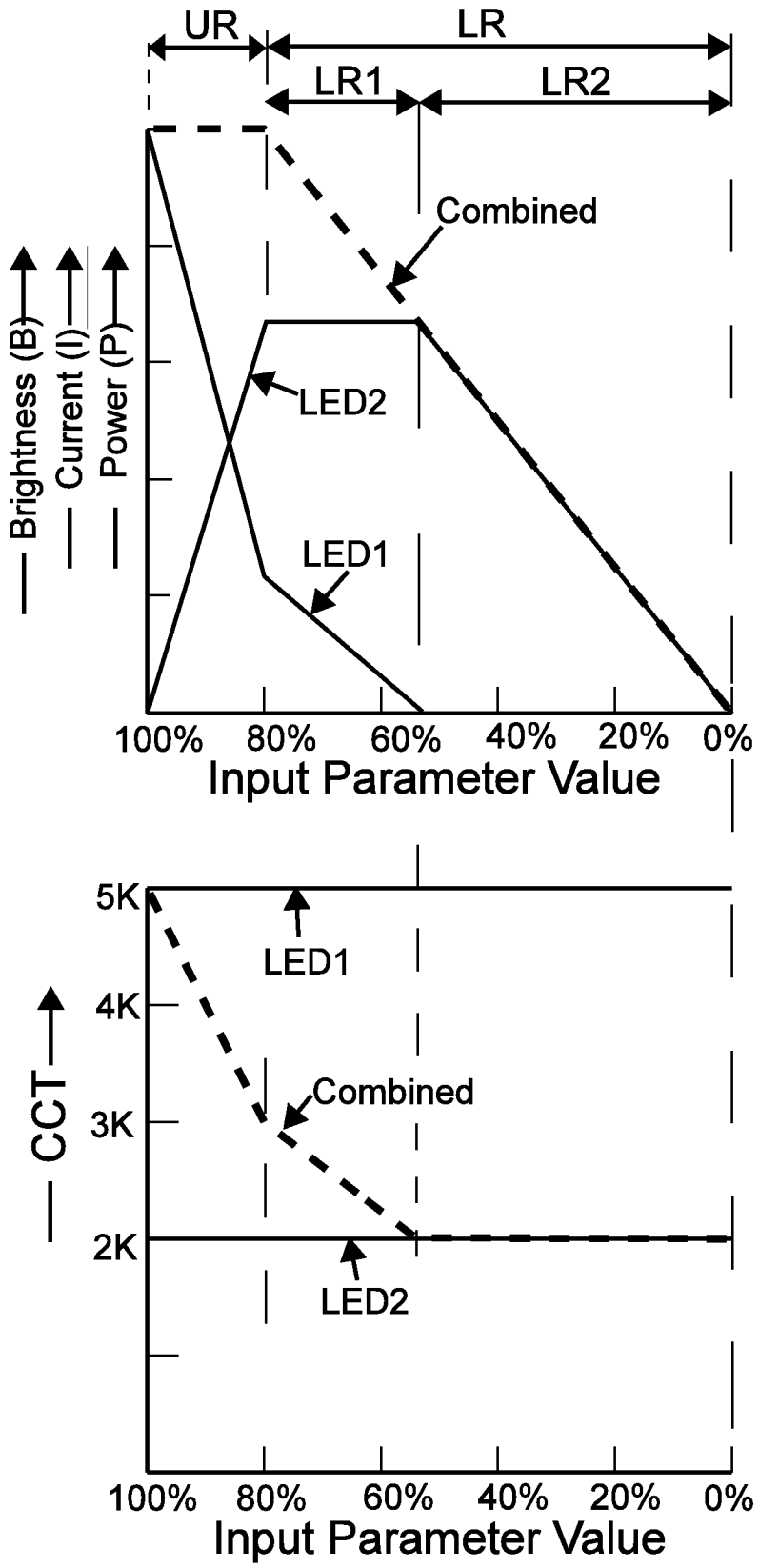

FIGS. 5-6 show graphs illustrating other example power-distribution schemes for apportioning power to different light-emitting devices of the lamp as a function of a characteristic of the input supply power.

DETAILED DESCRIPTION

FIGS. 1-2 show an example lighting apparatus comprising a lamp 1 and a light-adjustment device 10. The lamp 1 in this example is a light fixture that outputs white light. The light-adjustment device 10 is used by a user to control characteristics of the white light, including the white light's brightness and correlated color temperature (CCT). In this example, the light fixture 1 is a recessed light that is shown installed in a hole in a ceiling C. The dimmer switch 10 is configured to be wall-mounted, and is shown installed in an electrical box 14 in a wall W (e.g., through a hole in the wall).

In the following description of the lighting apparatus, directional terms (e.g., vertical, horizontal, top, and bottom) are made with reference to a typical installed orientation of the lighting device 1.

The light fixture 1 has a housing 2. The housing 1 has a top defined by a horizontal flat top surface 3. The housing 2 also has a side surface 4 that projects vertically downward from the top surface 3 and extends fully about the housing 2 to define a bottom opening 6. The bottom opening 6 is open to a light cavity 7 in the housing 2. In the light cavity 7, a first light-emitting device L1 and a second light-emitting device L2 are mounted to a horizontal internal surface 8 in the housing 2. The first and second light-emitting devices L1, L2 emit light that exits the cavity 7 through the bottom opening 6 and is directed downward from the ceiling C. The bottom opening 6 is surrounded and bounded by a flange 9 that extends radially outward from the bottom opening 6. In this example, the top surface 3, the side surface 4, the bottom opening 6, and the flange 9 have a generally-rectangular shape.

In this example, the first light-emitting device L1 is configured to emit a first white light of a first correlated color temperature (CCT). The second light-emitting device L2 is configured to emit a second white light of a second CCT that is lower than the first CCT. In this example, each of the first and second light-emitting devices L1, L2 is an LED device. Each LED device comprises one or more LEDs (LED1, LED2). In this example, each LED device L1, L2 comprises a string of LEDs (LED1, LED2) electrically connected in series. The CCT of each LED tends to remain constant over a wide operational range of powers (currents) applied to the respective LED.

The housing 2 supports the first and second light-emitting devices L1, L2 in positions relative to each other such that the first white light emitted by the first LED device L1 will mix with the second white light emitted by the second LED device L2 to yield a combined white light that has a combined CCT with a combined brightness.

The combined white light exits the light cavity 7 through the bottom opening 6. To let the combined white light pass through the bottom opening 6, the bottom opening might be uncovered or, alternatively, might be covered by a transparent covering or a translucent covering (light diffuser).

The light-adjustment device 10 is used to adjust characteristics (e.g., brightness and CCT) of combined white light emitted by the light fixture 1. The light-adjustment device 10 in this example is user adjustable, in that it can be adjusted manually (i.e., by a person). In this example, the light-adjustment device 10 is a user-adjustable dimmer switch 10 (dimmer 10).

The dimmer 10 includes a dimmer base 11 that is shown mounted to the wall W. The dimmer base 11 is located within an electrical box located behind the wall W (through a hole in the wall).

The dimmer 10 (light-adjustment device) further includes a user-interface component 12. The user-interface component 12 in this example is a protrusion that projects horizontally outward through a slot 13 in the dimmer base 11. The user-interface component 12 is user-adjustable in that it can be moved by a user (e.g., by the user's finger) across an operational full-scale range from a first end of the operational range to an opposite second end of the operational full-scale range. This range is "operational full-scale" in that it defines a full-scale range of positions and values that the dimmer 10 is capable of providing when the dimmer is operating as intended and designed.

In this example, the protrusion-type user-interface component 12 is a slider, and the positional movement is linear in that the user can slide the protrusion 12 linearly (in a straight line) along a range of positions (positional full-scale range) from the first end of the linear positional full-scale range to the opposite second end of the linear positional full-scale range, and vice versa (i.e., from the second end back to the first end). The first and second ends of the positional operational full-scale range in this example are, respectively, at or near the opposite ends of the slot 13. The range is "positional" in that it refers to a range of positions that the slider can be moved to.

In another example, the protrusion-type user-interface component might be a rotatable knob and the positional movement is rotational (instead of linear). The knob might project from the dimmer base 11 and be moved rotationally (i.e., turned) by the user's fingers along a range of angular positions (angular positional full-scale range) from a first end of the angular positional full-scale range (e.g., fully counterclockwise) to a second end of the angular positional full-scale range (e.g., fully clockwise), and vice versa.

In the above examples, the user-interface components (slider and knob) are physical components that can be grasped and moved by a user. In other examples, the user-interface component is instead displayed, such as on a display screen. An example of a displayed user-interface component is a virtual component, i.e., an image (e.g., on a touchscreen) that simulates a physical component, such as a virtual (displayed image of) a slider or a knob. Virtual user-adjustable components might be moved by the user swiping the virtual component on a touch screen or by the user grabbing-and-moving the virtual component with a mouse.

Another example of a displayed user-interface component is a displayed bar graph, in which the number of bars that are lit indicates a value that is user-selected (user-adjusted) by, for example, touching a displayed up-arrow and a displayed down-arrow.

Another example of a displayed user-interface component is a numeric display whose displayed number indicates a value that is user-adjustable by, for example, touching a displayed up-arrow and a displayed down-arrow. The numeric display is, unlike the other examples above, not "positional" in that the user-selected value it indicates is not defined by its position.

In each of the above examples, a value indicated by the physical or displayed user-interface component is user-adjustable across a predetermined operational full-scale range, from a first end of the range to a second end of the range.

In the examples of a numeric display and a bar graph, the user-selectable positions are discrete and finite-in-number and spaced apart along the length of the range, from the full-scale range's first end to the full-scale range's second end. In the example of a numeric display, the first and second ends of the full-scale range might respectively be 100 and zero, with the numerical value being user-adjustable between a finite number (e.g., 101) of discrete values between (and including) 100 and zero. In the example of a ten-bar bar graph, the first and second ends of the operational full-scale range might respectively be ten bars lit and zero bars lit, with the number-of-bars lit being a finite number (e.g., eleven) of discrete values between (and including) ten and zero.

Alternatively, as in the examples of a physical linear slider and physical rotary knob, the number of positions that can be user-selected in the operational range might be substantially (as it appears to the user) infinite, so that the user-interface component 12 is continuously-variable in terms of position, and the user-adjustable component 12 is moveable to any position between the first and second ends of the operational range.

The dimmer switch 10 in this example receives (inputs) dimmer-supply power, in the form of high-voltage (HV) alternating current (AC), through a dimmer-supply cable 30. In FIG. 2, arrows on cable 30 indicate the direction of power flow. In the U.S., the high-voltage is typically 120 VAC and called mains power. The cable 30 might have two lines—comprising a hot wire and a neutral wire. Alternatively, the dimmer 10 might receive low-voltage (LV) (e.g., 10-12V) direct current (DC) dimmer-supply power from one or more replaceable batteries that are installed within the dimmer 10. Alternatively, the dimmer 10 might receive LV-DC dimmer-supply power from an HV-AC/LV-DC converter that is external to the dimmer 10, such as a wall adapter (wall charger).

The dimmer switch 10 in this example outputs a user-adjustable LV-DC output voltage. The level of the output voltage might have an operational full-scale voltage range from a first end (in this example 0V) of the full-scale voltage range to an opposite second end (in this example 10V) of the full-scale voltage range. The dimmer's output voltage might be a monotonic function of the user-selected setting of the user-interface component 12. For example, if the user-interface component 12 is a slider (described above), the dimmer's output voltage might progressively change (e.g., rise) from the voltage-range's first end to the voltage-range's second end as the slider is slid from its positional-range's first end (e.g., at the bottom of the slot 13) to its positional-range's second end (e.g., at the top of the slot 13). Alternatively, if the user-interface component is a rotatable knob (described above), the output voltage might progressively change (e.g., rise) from the voltage-range's first end to the voltage-range's second end as the knob is turned from its positional-range's first end (e.g., fully counterclockwise) to its positional-range's second end (e.g., fully clockwise). Alternatively, if the user-interface component is a bar graph or numeric display (described above), the output voltage might progressively change (e.g., rise) from the voltage-range's first end to the voltage-range's second end as the bar graph or numerical display is progressively user-adjusted (e.g., upward) from its first end (e.g., minimum) value to its second end (e.g., maximum) value. In any of the example user-interface components described above, the user-interface component's output value may be expressed as a percentage, from 0% through 100%, in which 0% corresponds to the first end of the full-scale range and 100% corresponds to the second end of the full-scale range, or vice versa.

The dimmer switch 10 includes an on-off switch 15. In this example, the on-off switch 15 is in the form of a rocker switch. When the on-off switch 15 is in an ON position, the dimmer switch 10 output is a function of the position of the slider-type user-interface component as explained above. In contrast, when the on-off switch 15 is in an OFF position, the dimmer switch 10 output might be open circuit, or closed-circuit (i.e., 0VDC), or at the voltage-range's first end voltage (which is 0VDC in this example).

The light fixture 1 includes a controller 20 mounted within the light fixture housing 2. The controller 20 receives (inputs) operating power from (is powered by) the HV-AC power (e.g., 120 VAC) through a power cable 30. The power cable 30 might include a hot wire and a neutral wire.

The controller 20 internally includes electrical components, such as a hardware processor and/or discrete components, for implementing functions of the controller 20. One function of the controller 20 includes converting the HV-AC power to low-voltage direct-current (LV-DC) power, to be used for powering the controller itself (including the controller's logic circuitry) and for powering (providing supply-power to) the LED devices (L1, L2).

The controller 20 inputs the dimmer's low-voltage direct-current (LV-DC) output voltage through a LV cable 31. The LV cable 31 might include a twisted-pair comprising a signal wire and a ground wire. The dimmer output is a "controller input" from the viewpoint of the controller 20. The controller 20 distributes (apportions) LED-supply power to the LED devices L1, L2 according to method described in the following paragraphs.

The dimmer's output (i.e., controller-input through cable 31) might have any full-scale voltage range. More specifically, the first end of the full-scale voltage range might be any voltage, for example −10V, 0V or −1V. And the second end of the full-scale voltage range might be any other voltage, for example 1V or 10V. However, to simplify the following explanation of the controller's operation, the dimmer's output voltage is exemplified as having a full-scale range of 0-10V, such that the range's first end is simply designated 0V and the voltage range's second end is simply designated 10V.

In operation, the controller 20 measures the controller's input voltage (Vin), which is equivalent to the dimmer's output voltage. The controller 20 differentiates between whether Vin is in an upper range (UR) or a lower range (LR).

The upper range (UR) might have a top end that is at, or at least substantially at, 10V (i.e., the full-scale voltage range's second end). Alternatively, the upper range might be spaced from the 10V. The upper range might have a bottom end corresponding to a predetermined midpoint of the 0-10V full-scale range, such as in the range 3-9V. The predetermined midpoint in this example is 8V.

In this example, the lower range (LR) is contiguous with the upper range, in that the lower range has a top end that is (at least substantially) at the 8V (which is the bottom of the upper range). In other examples, the lower range might not be contiguous with the upper range. The top end of the lower range might be in the range 3-9V. In this example, the bottom end of the lower range is (at least substantially) at 0V. In other examples, the bottom end of the lower range might be spaced above 0V.

The controller 20 distributes (apportions) the input supply power to the first and second light-emitting devices L1, L2 according to a power-distribution scheme.

FIG. 3 provides an example of the power-distribution scheme. FIG. 3 includes graphs that illustrate an example of how LEDs' current (I), power (P), brightness (B), and correlated-color temperature (CCT) might be a function of the voltage level of the dimmer-output (which is equivalent to the controller-input). In the present examples, I, P and B are proportional to each other, so that a single graph in FIG. 3 suffices to characterize all of them. All values in the X-axes of FIG. 3 are in terms of Vin which has a full-scale range of 0-10V in this example.

The power-distribution scheme is explained below with reference to the following terms: Brightness values emitted by the first and second light-emitting devices L1, L2 are respectively called first brightness and second brightness. Brightness of the combined light is called combined brightness. Electrical current and power that are supplied by the controller 20 to the first light-emitting device L1 are respectively called first current and first power. Electrical current and power supplied by the controller 20 to the second light-emitting device L2 are respectively called second current and second power. The sum of the electrical currents and the sum of the electrical powers supplied by the controller 20 to both the first and second light-emitting devices L1, L2 are respectively called combined current and combined power.

The controller 20 determines whether the controller-input voltage (Vin) is in an upper portion of the lower range (LR1) or in a lower portion (LR2) of the lower range (LR). In the example of FIG. 3, UR extends from 10V down to 8V, LR extends from 8V down to 0V, LR1 extends from 8V to about 5.5V, and LR2 extends from about 5.5V down to 0V.

If/when Vin is in the upper range (UR), as Vin decreases: (A1) the combined CCT decreases and the combined brightness remains constant; and/or (A2) the first current decreases, the second current increases, and the combined current remains constant; and/or (A3) the first power decreases, the second power increases, and the combined power remains constant.

If/when Vin is in the lower range (LR), as Vin decreases: (B1) the combined brightness decreases; and/or (B2) the combined current decreases; and/or (B3) the combined power decreases.

If/when Vin is in the upper portion (LR1) of the lower range, as Vin decreases: (C1) the first brightness decreases, the second brightness remains constant, and the combined CCT decreases; and/or (C2) the first current decreases, and the second current remains constant; and/or (C3) the first power decreases, and the second power remains constant.

If/when Vin is in the lower portion (LR2) of the lower range, as Vin decreases: (D1) the first brightness remains constant (in this example zero), the second brightness decreases, and the combined CCT remains constant; and/or (D2) the first current remains constant, and the second current decreases; and/or (D3) the first power remains constant, and the second power decreases.

The above example scheme includes steps in which a parameter "remains constant". In a related example scheme, those steps might specify that the parameter "remains substantially constant."

FIG. 4 is a flow chart illustrating a method that the controller 12 would implement if all of the overmentioned steps (A1-A3, B1-B3, C1-C3, D1-D3) would happen to be implemented. FIG. 4 uses the following abbreviations: "Vin" to mean controller's input voltage; "pwr" to mean power; "incr" and "decr" to mean increases and decreases respectively, "$1^{st}$ brightness" to mean first light-emitting device's brightness; and "$2^{nd}$ brightness" to mean second light-emitting device's brightness.

Logic steps (A1-A3, B1-B3, C1-C3, D1-D3) of the power-distribution method might be performed by a processor-based device, such as a microcontroller executing program code. In other examples, the steps might be performed by electrical circuitry using discrete components.

Example characteristics for the lighting device 1 might be the following: The first CCT is in the range 4000K to 7000K, such as 5000K. The second CCT is in the range 1500K to 3000K, such as 2000K. Combined CCT is in the range 4500K to 6500K, such as 5000K, when Vin is at the top of the first range. Combined CCT is in the range 2500K to 3500K, such as 3000K, when Vin is at the bottom of the first range and the top of the second range. Combined CCT is in the range 1500K to 2500K, such as 2000K, when the Vin is at the bottom of the second range.

In the above examples, the light-adjustment device 10 is remote from the light fixture 1. Alternatively, the light-adjustment device 10 might be within the light fixture 1.

In the above examples, the controller 20 is mounted in the same light-fixture housing 2 as are the light-emitting devices L1, L2. Alternatively, the controller 20 might be remote from the light-fixture housing 2 and the light-emitting devices L1, L2.

In the above examples, the power-distribution scheme is expressed in terms the controller's input-voltage Vin. In another example, the power distribution scheme can be expressed in terms of an input parameter value that is a user-interface indication that is a seen by the user; for example the number displayed by a user-controlled numeric display, or the number of bars that are lit on a user-controlled bar graph, or the angular position of a user-controlled rotary knob, or the linear position of a user-controlled slider. In that case, in the above paragraphs and FIGS. 3-4 that describe the power-distribution scheme, the term "user-interface indication" can replace the term "Vin". And the upper and lower ranges (UR, LR, LR1, LR2) would be ranges of "user-interface indication" (instead of ranges of Vin). For example, consider a case in which the slider switch 12 is slidable along a full-scale distance (range) of 0-10 cm, from a bottom position designated as having a position value of 0 cm to a top position designated as having a position value of 10 cm. The power-distribution scheme might be expressed in terms "slider position value" instead of Vin, and the X axes in FIG. 3 would range from 10 cm (at the left) to 0 cm (at the right).

In the above examples, the characteristic value (upon which the distribution scheme is based) is selected manually by a user. In another example, the characteristic value is selected in an automated fashion by a logic device, such as a microprocessor-based device (e.g., computer), that determines what value the controller-input voltage (Vin) should have based on a program or sensors. For example, the logic device might raise Vin (to raise brightness and CCT) when a sensor senses that a person has entered the room and might lower Vin (to lower brightness and CCT) when the sensor senses that the person has left the room. Or the logic device might raise Vin (to raise brightness and CCT) at one preselected time of day and might lower Vin (to lower brightness and CCT) at another preselected time of day. The logic device might communicate with the light-adjustment device 10 through wired communication or wireless communication. Or the logic device might be contained in, and/or part of, the light-adjustment device 10 itself.

In the above examples, the user-interface component 12, whether a physical component or a virtual image, is located on the light-adjustment device 10 (dimmer switch) itself. Alternatively, the user-interface component might be an image displayed on a screen of a remote communication device that is in wireless communication with the light-adjustment device 10. In one example, the communication device is a smartphone. The user-interface component might be a user-adjustable image that is displayed on the smartphone's screen by an app, to receive the user's manually-entered (e.g., by touchscreen) selection of a value. Or the smartphone, under control of the app, might receive the user-selected value through audio input (e.g., through the smartphone's internal microphone). The smartphone (under control of the app) might then communicate (e.g., through Bluetooth or Internet, e.g., through cable or wirelessly) the user-selected value to the light-adjustment device 10.

In the above examples, the controller 10 receives operating power from a HV-AC power supply delivered through cable 30 and receives a control signal Vin (upon which the distribution scheme is based) through cable 31. In other words, the power supply input (via cable 30) and the control-signal input (via cable 31) are separate from each other. In another example, the controller 20 might be powered by the control signal itself (via cable 31), and therefore not require a separate power supply input through cable 31.

FIGS. 5-6 show graphs illustrating other example power-distribution schemes (differing from that of FIG. 3) for apportioning power to different light-emitting devices of the lamp as a function of a characteristic of the input supply power.

Other examples might have the following characteristics:

0-10V might only retain UR and LR without the LR1 concept.

At LR, as Vin decreases, both the first brightness and the second brightness decreases, but the combined CCT remains constant. And/or the first current and the second current decrease, but the current ratio remains constant. And/or the first power and the second power are reduced, but the power ratio remains constant.

In a higher range, the composition ratio of the first current and the second current might be set by a dial switch. In the lower range, the first current of the luminaire might be set to a minimum ratio. When Vin decreases, the first current and the second current might decrease synchronously, and the combined current ratio might remain constant.

In an upper range, the composition ratio of the first power and the second power might be set by a dial switch. In the lower range, the first power set by the luminaire might be a lowest ratio, and as Vin decreases, the first power and the second power might decrease synchronously, and the combined power ratio might remain constant.

In other examples, the supply power might be a dimmer with a variable resistance value, built in the wall switch. The switch might control AC to realize the opening and closing of the device. The variable resistor might change the Vin value to complete the color temperature and dimming.

In the upper range, the adjustable range of the range for current, power, color temperature, etc. corresponding to Vin might be set by the dial switch. In the lower range, the luminaire might be set to the minimum current, power, color temperature, etc. When Vin decreases, the first brightness and the second brightness might decrease synchronously, and the current, power, color temperature, etc. of the combined light might remain constant.

In the upper range, the adjustable range of the range for current, power, color temperature, etc. for Vin might be set by the DIP switch. In the lower range, the luminaire is the set minimum of current, power, color temperature, etc. When Vin decreases, the first brightness and the second brightness decrease synchronously, and the current, power, color temperature, etc. of the combined light remains constant.

In the upper range, the CCT adjustable range might be set by the DIP switch. In the lower range, the luminaire might be set to the minimum color temperature. As Vin decreases, the first brightness and the second brightness might decrease synchronously, and the color temperature might remain constant.

In the upper range, the composition ratio of the first current and the second current might be set by a dial switch. In the lower range, the first current of the luminaire might be set to a minimum ratio. When Vin decreases, the first current and the second current might decrease synchronously, and the combined current ratio might remain constant.

In the upper range, the composition ratio of the first power and the second power might be set by a dial switch. In the lower range, the first power minimum ratio set by the luminaire. When Vin decreases, the first power and the second power might decrease synchronously, and the combined power ratio might remain constant.

In the upper range, the composition ratio of the first power and the second power might be set by the dial switch. In the lower range, the first power set by the luminaire might be the lowest ratio, and as Vin decreases, the first power and the second power might decrease synchronously, and the combined power ratio might remain constant.

The device might provide a 12V power supply to supply power to the dimmer, and the dimmer might realize color temperature and dimming function through wireless communication.

The dimmer 10 might be a variable resistor that changes the value of Vin by changing the resistance.

The dimmer might be integrated in the wall switch.

When the on/off switch 15 is in the ON position, the grid might supply AC power to the luminaire. When the on/off switch is in the OFF position, the AC supply to the luminaire might be disconnected.

The components and procedures described above provide examples of elements recited in the claims. They also provide examples of how a person of ordinary skill in the art can make and use the claimed invention. They are described here to provide enablement and best mode without imposing limitations that are not recited in the claims. In some instances, in the above description, a term is followed by a substantially equivalent term or an alternative term enclosed in parentheses.

The invention claimed is:

1. An apparatus comprising:

a controller configured to provide power to:

a first light-emitting device that is configured to emit a first white light of a first correlated color temperature (CCT);

a second light-emitting device that is configured to emit a second white light of a second CCT that is lower than the first CCT, for the first white light to mix with the second white light to yield a combined white light having a combined-light CCT with a combined-light brightness;

receive a user-adjustable DC input voltage Vin; and distribute supply power to the first and second light-emitting devices according to a power-distribution scheme that differentiates between whether Vin is in an upper range or a lower range such that:

throughout the upper range: as Vin decreases, the combined-light CCT decreases and the combined-light brightness remains substantially constant, and throughout the lower range: as Vin decreases, the combined-light brightness decreases.

2. The apparatus of claim 1, wherein the power-distribution scheme further differentiates between whether Vin is in an upper portion of the lower range or a lower portion of the lower range such that:

in the upper range, the CCT adjustable range can be set by the DIP switch, and in the lower range, the luminaire can set the minimum color temperature, and as Vin decreases the first brightness and the second brightness decrease synchronously, and the color temperature remains constant.

3. The apparatus of claim 1, wherein electrical currents applied by the controller to the first and second light-emitting devices are respectively first current and second current;

the sum of the first and second currents is combined current; and the power-distribution scheme further includes:

throughout the upper range: as Vin decreases, the first current decreases, the second current increases, and the combined current remains constant, and throughout the lower range: as Vin decreases, the combined current decreases.

4. The apparatus of claim 3, wherein the power-distribution scheme further differentiates between whether Vin is in an upper portion of the lower range or a lower portion of the lower range such that:

in a higher range, the composition ratio of the first current and the second current can be set by a dial switch, and in the lower range, the first current of the luminaire is set to a minimum ratio, and when Vin decreases, the first current and the second current decrease synchronously, and the combined current ratio remains constant.

5. The apparatus of claim 1, wherein electrical powers applied by the controller to the first and second light-emitting devices are respectively first power and second power;

the sum of the first and second powers is combined power; and the power-distribution scheme further includes:

throughout the upper range: as Vin decreases, the first power decreases, the second power increases, and the combined power remains constant, and throughout the lower range: as Vin decreases, the combined power decreases.

6. The apparatus of claim 5, wherein the power-distribution scheme further differentiates between whether Vin is in an upper portion of the lower range or a lower portion of the lower range such that:

in a higher range, the composition ratio of the first power and the second power can be set by a dial switch, and in the lower range, the first power minimum ratio set by the luminaire, when Vin decreases, the first power and the second power are synchronously reduced, and the combined power ratio remains constant.

7. The apparatus of claim 1, wherein the lower range is contiguous with the upper range.

8. The apparatus of claim 1, wherein the supply power is obtained from a power source other than the user-adjustable DC input voltage Vin, and it can also be a dimmer with a variable resistance value, built in the wall switch, the switch can control AC to realize the opening and closing of the device, and the variable resistor can change the Vin value to complete the color temperature and dimming.

9. The apparatus of claim 1, further comprising:

the first and second light-emitting devices; and a light-fixture housing that supports the first and second light-emitting devices in positions relative to each other such that the first white light will mix with the second white light to yield the combined white light.

10. The apparatus of claim 9, wherein the first light-emitting device comprises one or more LEDs, and the second light-emitting device comprises one or more LEDs.

11. The apparatus of claim 9, wherein:

the first CCT is in the range 4000K to 7000K, the second CCT is in the range 1500K to 3000K, and the combined-light CCT is:

in the range 4500K to 6500K when Vin is at a top of the upper range, in the range 2500K to 3500K when Vin is at a bottom of the upper range and a top of the lower range, and in the range 1500K to 2500K when Vin is at a bottom of the lower range.

12. The apparatus of claim 9, further comprising a dimmer that is configured to output Vin and that includes a user-interface component through which a user can adjust the level of Vin.

13. The apparatus of claim 12, wherein the user-interface component is a physical component that is configured to be manually moved by a user to adjust the level of Vin.

14. The apparatus of claim 9, wherein the light-fixture housing is configured to be mounted in a ceiling for recessed lighting.

15. A method for powering a (i) first light-emitting device configured to emit a first white light of a first correlated color temperature (CCT) and (ii) a second light-emitting device configured to emit a second white light of a second CCT with a second brightness, wherein the second CCT is lower than the first CCT, for the first white light to mix with the second white light to yield a combined white light having a combined-light CCT with a combined-light brightness, the method comprising:

receiving an input voltage Vin; and distributing the input supply power to the first and second light-emitting devices according to a power-distribution scheme that differentiates between whether Vin is in an upper range or a lower range such that:

throughout the upper range: as Vin decreases, the combined-light CCT decreases and the combined-light brightness remains substantially constant, and throughout the lower range: as Vin decreases, the combined-light brightness decreases.

16. The method of claim 15, wherein the power-distribution scheme further differentiates between whether Vin is in an upper portion of the lower range or a lower portion of the lower range such that:

in the upper range, the adjustable range of the tonal temperature range for Vin can be set by the DIP switch, and in the lower range, the luminaire is the set minimum color temperature, and when Vin decreases, the first brightness and the second brightness decrease synchronously, and the CCT of the combined light remains constant.

17. The method of claim 15, wherein electrical current applied by the controller to the first and second light-emitting devices are respectively first current and second current;

the sum of the first and second currents is combined current; and the power-distribution scheme further includes:

in the upper range, the composition ratio of the first current and the second current can be set by the dial switch, and in the lower range, the first current of the luminaire is set to a minimum ratio, and when Vin decreases, the first current and the second current decrease synchronously, and the combined current ratio remains constant.

18. The method of claim 15, wherein electrical current applied by the controller to the first and second light-emitting devices are respectively first power and second power;

the sum of the first and second currents is combined power; and the power-distribution scheme further includes:

in the upper range, the composition ratio of the first current and the second current can be set by the dial switch, and in the lower range, the first current of the luminaire is set to a minimum ratio, and when Vin decreases, the first current and the second current decrease synchronously, and the combined current ratio remains constant.

19. A light fixture comprising:

a first LED device that is configured to emit a first white light of a first correlated color temperature (CCT) in the range 4000K to 7000K;

a second LED device that is configured to emit a second white light of a second CCT in the range 1500K to 3000K;

a housing that supports the first and second light-emitting devices in positions relative to each other such that the first white light will mix with the second white light to yield combined white light of a combined-light CCT having combined-light brightness, and is configured to be installed in a ceiling as a recessed light fixture;

an input configured to receive a user-adjustable DC input voltage Vin; and a controller that is configured to:

distribute the input supply power to the first and second light-emitting devices according to a power-distribution scheme that differentiates between whether Vin is in an upper range or a lower range such that:

throughout the upper range: as Vin decreases, the combined-light CCT decreases and the combined-light brightness remains substantially constant, and throughout the lower range: as Vin decreases, the combined-light brightness decreases.

20. The apparatus of claim 19, wherein the power-distribution scheme further differentiates between whether Vin is in an upper portion of the lower range or a lower portion of the lower range such that:

in the upper range, the adjustable range of the tonal temperature range for Vin can be set by the DIP switch, and in the lower range, the luminaire is the set minimum color temperature, and when Vin decreases, the first brightness and the second brightness decrease synchronously, and the CCT of the combined light remains constant.

* * * * *